US006823557B2

(12) United States Patent
Dingert

(10) Patent No.: US 6,823,557 B2
(45) Date of Patent: Nov. 30, 2004

(54) WRINGING DEVICE FOR CLEANING ELEMENTS OF WET AND MOIST MOPS

(75) Inventor: Uwe Dingert, Abtsteinach (DE)

(73) Assignee: Firma Carl Freudenberg, Weinheim (DE)

( * ) Notice: Subject to any disclaimer, the term of this patent is extended or adjusted under 35 U.S.C. 154(b) by 150 days.

(21) Appl. No.: 09/960,213

(22) Filed: Sep. 21, 2001

(65) Prior Publication Data

US 2002/0066152 A1 Jun. 6, 2002

(30) Foreign Application Priority Data

Sep. 13, 2000 (DE) ..... 100 45 525

(51) Int. Cl.[7] ..... A47L 13/58; A47L 13/59
(52) U.S. Cl. ..... 15/260; 15/261
(58) Field of Search ..... 15/260, 261

(56) References Cited

U.S. PATENT DOCUMENTS 2,155,494 A * 4/1939 Kober ..... 15/260
6,530,112 B2 * 3/2003 Hirse ..... 15/260

FOREIGN PATENT DOCUMENTS

EP 0 489 237 6/1992

OTHER PUBLICATIONS

English Translation of EP 0 489 237, Weihrauch, Dec. 1, 1990.*

* cited by examiner

*Primary Examiner*—Robert J. Warden, Sr.
*Assistant Examiner*—Laura C Cole
(74) *Attorney, Agent, or Firm*—Kenyon & Kenyon

(57) ABSTRACT

A wringing device for cleaning elements of wet and moist mops, the wringing device having a liquid-permeable receptacle (1) which can be affixed to a container, and in which a cleaning element can be wrung out by the exertion of pressure, the receptacle having deformable wall parts (3) and the inside width of the receptacle changing when the cleaning element is pressed in due to the effective force of pressure, wall parts being formed from spring elements (3) with convex curvature, which can be deformed by exertion of pressure for the purpose of enlarging the inside width.

26 Claims, 3 Drawing Sheets

WRINGING DEVICE FOR CLEANING ELEMENTS OF WET AND MOIST MOPS

BACKGROUND OF THE INVENTION

1. Field of the Invention

The invention relates to a wringing device for cleaning elements of wet and moist mops, the wringing device having a liquid-permeable receptacle which can be affixed to a container, and in which a cleaning element can be wrung out by the exertion of pressure, the receptacle having deformable wall parts and the inside width of the receptacle changing when the cleaning element is pressed in due to the effective force of pressure.

2. Description of Related Art

Such a wringing device is known from European Patent 0 489 237. The wringing device has a liquid-permeable receptacle which is attached to the rim of a mop bucket and in which a moist mop can be wrung out by exerting pressure on it. The receptacle is formed in the shape of a funnel and has elastically deformable wall parts arranged at a distance from each other. These wall parts are curved in the form of an arch and are attached to the mounting frame of the receptacle with an external leg, while an inner leg is guided into in a bottom part of the receptacle. The apexes of the wall parts surround an opening for insertion of the wet mop. To squeeze cleaning liquid out of the wet mop, it is introduced into the receptacle from above and pressed downwards. The action of pressing the mop downwards transfers tensile forces from the bottom to the inner legs of the elastic wall parts. In the area of the apexes, these tensile forces act as bending moments so that the legs are elastically deformed inwards. The wall parts to be moved towards each other cause the inside width of the insertion opening to be reduced. The wall parts are pressed against the wet mop, causing the liquid to be squeezed out of it. The liquid can drain down between the wall parts into the mop bucket. When at the end of the cleaning process water is to be returned from the floor into the mop bucket by the wiping mop, the mop must be sufficiently wrung out. However, a very good wringing result can only be obtained with considerable exertion of force. In order to properly reduce the inside width of the squeeze space during squeezing, the bottom of the receptacle must be pressed strongly downwards. Only in this way is it possible to squeeze out the necessary amount of liquid, in particular from the inner area of the mop fibers. Since the squeezing pressure is not directly converted into a reduction of the squeeze space, but rather parts of the receptacle are also deformed, making it possible for the legs to move towards each other, the joints and the shoulders of the user are subjected to an undesirable load. This makes the use of the wringing device more difficult.

SUMMARY OF THE INVENTION

It is an object of the invention to specify a wringing device in which the wringing action takes place more favorably than heretofore and with less exertion of force, which has a simple structure, can be manufactured in a more cost-effective manner and is well suited for household use.

These and other objects of the invention are achieved in a device for cleaning elements of wet and moist mops, the wringing device having a liquid-permeable receptacle which can be affixed to a container, and in which a cleaning element can be wrung out by the exertion of pressure, the receptacle having deformable wall parts and the inside width of the receptacle changing when the cleaning element is pressed in due to the effective force of pressure, wherein the wall parts are in the form of spring elements with convex curvature, which can be deformed by the compression force for the purpose of enlarging the inside width.

BRIEF DESCRIPTION OF THE DRAWINGS

The present invention will be described in greater detail with reference to the following drawings wherein.

DETAILED DESCRIPTION OF THE INVENTION

Figure 1:
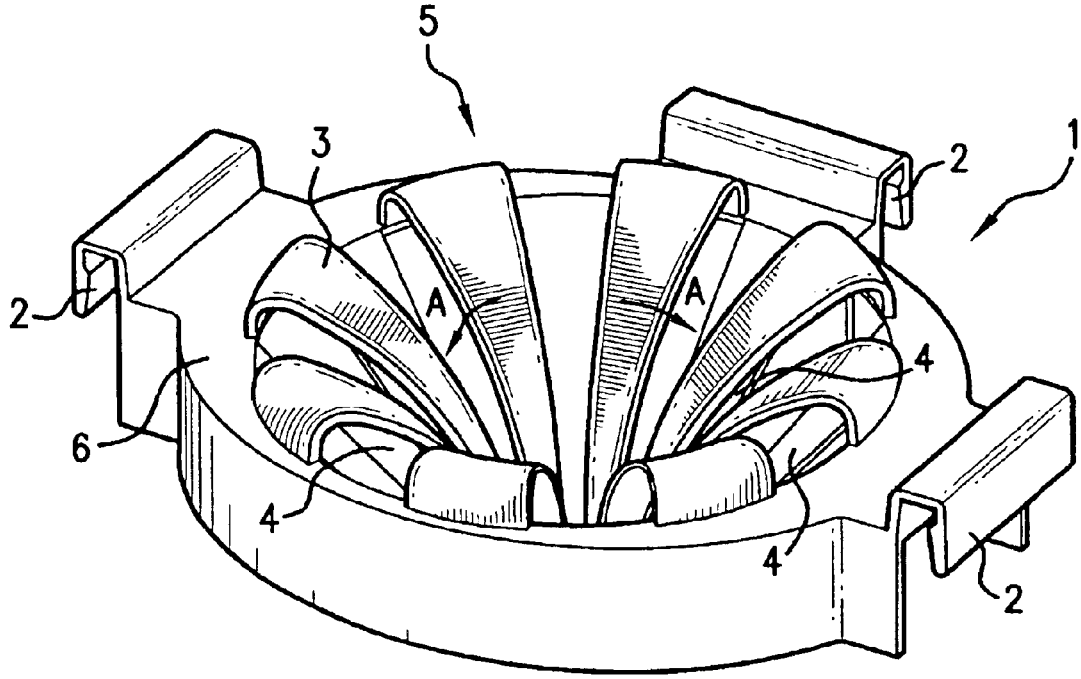
FIG. 1 shows a three-dimensional representation of a preferred exemplary embodiment of the wringing device.

In order to attain the objective, the wall parts are formed as spring elements with convex curvature, which can be shaped by exertion of pressure for the purpose of enlarging the inside width. In this connection, the invention is based on the knowledge that an efficient wringing result is attained in particular when the downward pressure is directly converted into a squeezing pressure and does not contribute to a deformation of parts of the receptacle, which do not result in a reduction of the squeeze space. For this purpose, the present invention provides spring elements which are convexly curved in the direction of the squeeze space in a neutral position. During the squeezing out operation, the downward pressure does not result in a reduction but rather in an enlargement of the inside width of the squeeze space. Pressing the cleaning element in causes the spring elements to act as deformable squeezing pressure surfaces and their convex curvature is reduced as the downward pressure increases. According to the present invention, this essentially only results in an elastic deformation of these spring elements but not in a deformation of other parts of the receptacle. This makes wringing out easier since only a slight downward pressure is necessary for a desired wringing result. The convex curvature of the spring elements which act on the mop from all sides even in the top area as the downward pressure increases, effectively converts the downward pressure into a squeezing pressure.

To remove the excess moisture from a scrub mop, a funnel-shaped receptacle has proven successful in which the spring elements form a squeeze basket tapering downwards in the shape of a tulip flower. For the wet mopping of large areas of floor coverings, a scrub mop is frequently used which can accommodate large quantities of water in absorbent strips. These absorbent strips are attached to a mop head on a handle in the form of tufts. A prerequisite for fast floor cleaning is that the strips are thoroughly rinsed by submerging them in water after each partial cleaning operation and then freeing them of excess moisture. At the end of the cleaning of a section of floor, the water containing floor dirt should be taken up as completely as possible and brought into the mop bucket by efficient wringing. The tulip-shaped, downward tapering shape of the squeeze basket can readily accommodate the large number of absorbent strips and makes it possible to wring them out with comparatively little squeezing force.

Advantageously, the receptacle has a bottom connected to a mounting frame by conical lateral surface parts, the upper end of each spring element being joined to the mounting frame and the lower end being joined to the bottom. In this manner, the distance between the bottom and the mounting frame of the receptacle is preserved during the exertion of pressure, as a result of which the downward pressure is efficiently converted into squeezing pressure, since the work of deformation is only applied to reduce the curvature of the spring elements and not for deforming parts of the receptacle, which contribute only indirectly to the removal of liquid from the cleaning element.

The wringing device can be manufactured in a cost-effective manner as an injection molded part from a polymer material. Advantageously, the lateral surface parts of the receptacle can be formed to be sufficiently rigid and the spring elements with the desired flexibility.

In order to make it possible for the squeezed out liquid volume to drain away with as little hindrance as possible, it is advantageous if the bottom has perforations.

It is an advantage if holding lugs are provided on the mounting frame in order to affix the receptacle to the rim of a mop bucket. The holding lugs of the wringing device clutch the rim of the mop bucket so that it is always ensured that when the mop is pressed in, it is effectively supported on the rim of the bucket and does not slip. A very secure fit of the mop bucket attachment is attained if three holding lugs are provided on the wringing device. In this connection, it is an advantage if the holding lugs have a groove facing the bucket wall which engages with the top lip of the mop bucket and consequently locks the wringing device to the rim of the bucket.

With respect to manufacturing, it is advantageous if the spring elements and the lateral surface parts are arranged radially around the bottom and with interspacing, a water passage opening being formed between each spring element and lateral surface part.

It is an advantage if each spring element, seen in the direction of its extension, has a different cross-section or a different profile between the mounting frame and the bottom. As a result, the spring elements can be designed in such a way that their pressing force varies in the vertical direction. When the cleaning element is pressed in, this also makes it possible for the liquid to be effectively pressed out of the top areas of the mop.

Preferably, an insertion funnel is located above the squeeze basket. The conical surfaces of this funnel form a guide for the strands of a mop hanging downwards, as a result of which they are bundled when they reach the insertion opening of the squeeze space.

Advantageously, a device is used for wet and moist mopping composed of a receptacle which is adapted to the scrub mop to be accommodated and the form of which is adapted to the size of the mop bucket.

FIG. 1 shows a three-dimensional view of an exemplary embodiment of the wringing device according to the present invention. The wringing device is formed by a receptacle 1, having an upper insertion opening where a cleaning element, for example, a wiping mop can be inserted and can be wrung out in a squeeze basket 5.

The wringing ensues by pressure and may also include twisting and winding of the mop.

Figure 2:
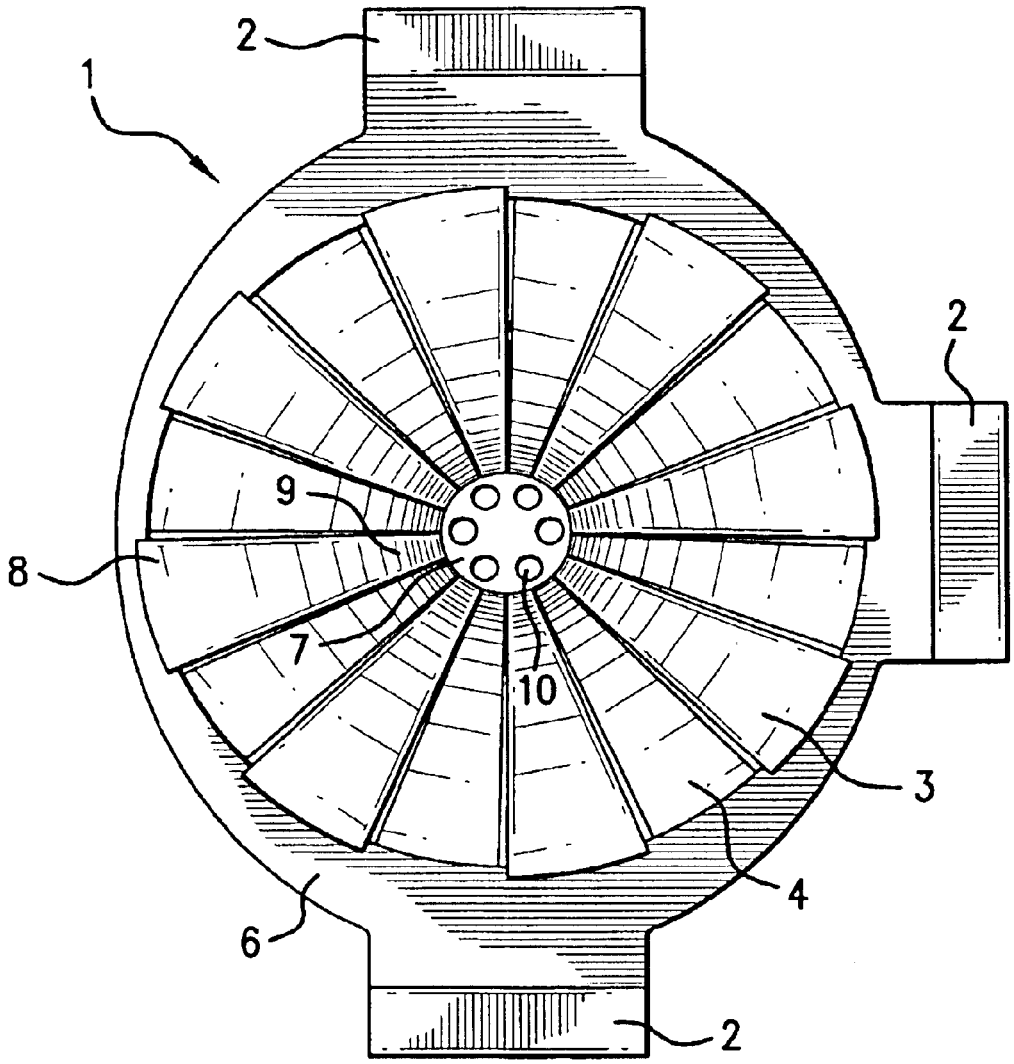
FIG. 2 shows a top view of the exemplary embodiment according to FIG. 1.
Figure 3:
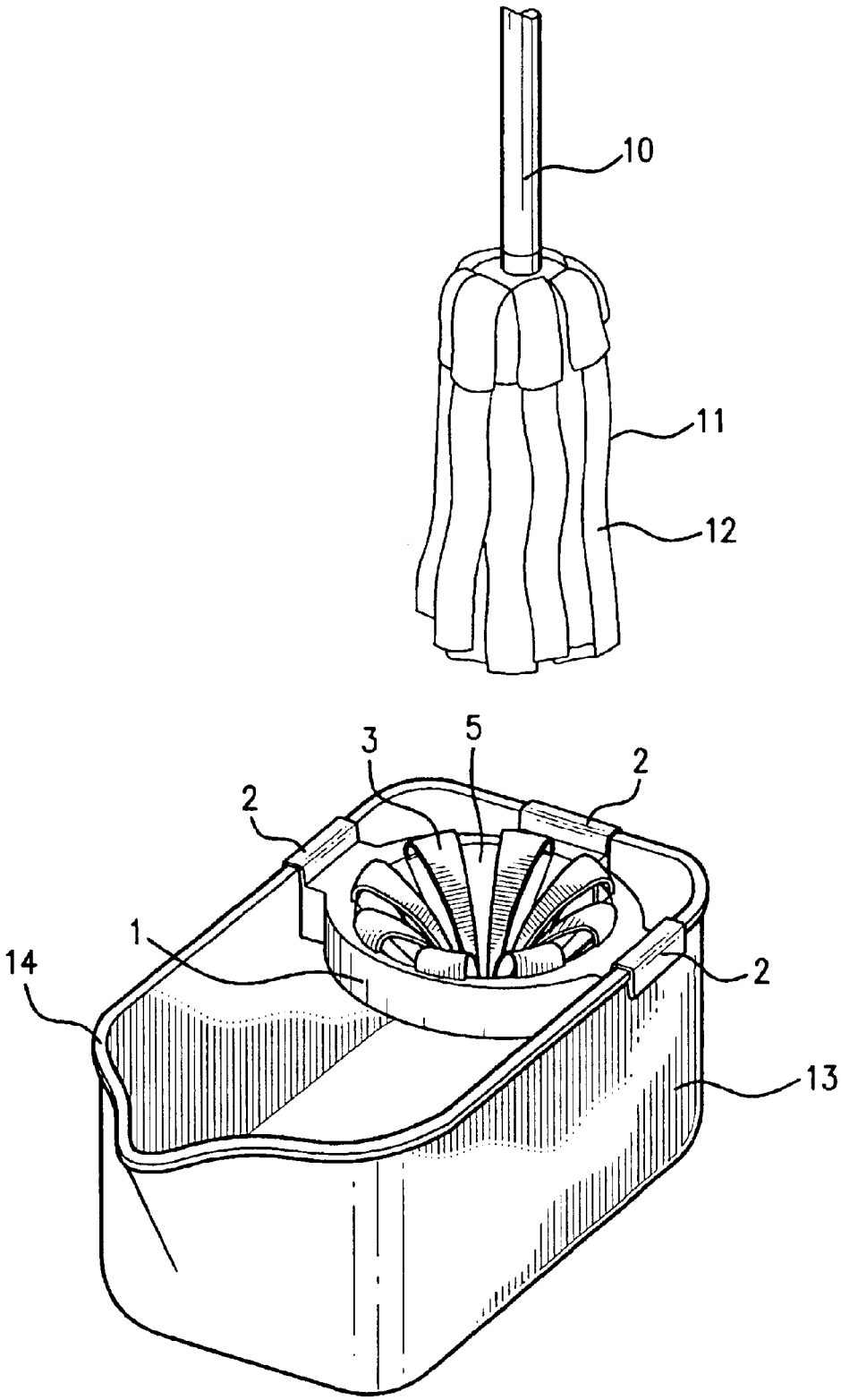
FIG. 3 shows a perspective view of a mop over a bucket containing the wringing device of FIG. 1.

Squeeze basket 5 is formed by elastically deformable wall parts or spring elements 3 which are tongue-shaped and extend downwards from a mounting frame 6 of receptacle 1 with increasing tapering. Each spring element 3 has a convex curvature and forms an inside width in the squeeze basket 5 which becomes larger when downward pressure is exerted on cleaning element 12 (FIG. 3) or, expressed in other words, the curvature of the spring elements 3 is reduced. Each spring element 3 has an upper end 8 which is preferably formed in the shape of an arch and is molded to mounting frame 6. If an imaginary tangent is drawn at upper end 8 at the apex of one spring element 3, the angle enclosed between the tangent and the vertical is reduced with increasing depth in squeeze basket 5. The lower end 9 of each spring element 3 merges into a bottom 7. As can be clearly seen in FIG. 2, spring elements 3 are arranged radially around bottom 7. In the embodiment of a basket-shaped squeeze chamber or squeeze basket 5 shown, the spring elements 3 seen from above have the form of isosceles triangles, the upper ends 8 of which are molded to the mounting frame 6 while their lower ends 9 merge into bottom 7. The squeeze chamber 5 may also have a different shape, for example, a prismatic one for a flat mop head. Supports 4 are drawn between spring elements 3 which extend downwards in the form of a hollow cone and the bottom ends of which also merge into bottom 7. Supports 4 form a carrier for bottom 7 and are subjected to tensile stress when downward pressure is exerted on the cleaning element 12. In the embodiment shown, spring elements 3 and supports 4 are arranged radially and with interspacing. If, in the embodiment shown, an imaginary surface of revolution is formed from spring elements 3 and a lateral surface of revolution is formed from lateral surface parts supports 4, these surfaces of revolution have a space between them. When the cleaning element 12 is squeezed out, this makes it possible for the liquid squeezed out to drain away vertically downwards into a mop bucket 13 (FIG. 3). In order to also make the drainage of liquid in the bottom easier, openings which are shown as holes 10 in FIG. 2. In order to wring liquid out of cleaning element 12, e.g., a strand-like cleaning element bundled into a mop head, its strands 11 hanging vertically downwards are inserted into the squeeze basket 5 which is open at the top. The squeeze basket 5 is advantageously shaped as a tulip flower with downward tapering. Since the mop head or cleaning element 12 attached to a handle 10 is pressed downwards in the direction of bottom 7, spring elements 3 form elastically formable squeezing pressure surfaces. These opposite surfaces press against the strands 11 of the cleaning element 12 when downward pressure is exerted and squeeze out the water absorbed in them.

The exertion of pressure causes the elastically compliant spring elements 3 to be pressed outwards in the direction of the arrows labeled A. This causes the inside width of the squeeze basket 5 to be enlarged. The downward pressure directed in the direction of the bottom of the bucket 13 is absorbed by supports 4 which connect bottom 7 and mounting frame 6. In contrast to spring elements 3, which are subjected to a bending force when pressure is exerted on the cleaning element 12, supports 4 are subjected to tensile stress. During the pressing, their shape does not change. The wringing device can be affixed to the mop bucket 13 with the aid of holding lugs 2. These holding lugs 2 engage an upper rim of a top lip 14 of the bucket 13, making it possible to lock the wringing device to the mop bucket 13. Three holding lugs are preferred, making it possible to attach the wringing device in a side area of the mop bucket 13 and leave sufficient room to submerge the cleaning element 12. The embodiment of the wringing device shown in the drawings can be manufactured in a cost-effective manner as a plastic injection molded part. In FIG. 1, the spring elements 3 are shown tapering sharply to the bottom but with the same wall thickness. A further improvement can be obtained if the spring elements 3 have a different cross-section or a different profile in their extension between the bottom and mounting frame. As a result, it is possible to produce opposing forces of varying strength of the spring elements 3 within the squeeze basket 5 as a function of their height in the squeeze basket 5 when the cleaning element 12 is pressed in. Since supports 4 of funnel-shaped receptacle 1 limit the downward movement when the cleaning element 12 is pressed in, an overexpansion of the spring elements 3 is prevented. In the embodiment shown in the drawings, the spring elements 3 and the supports 4 are arranged with interspacing. In FIG. 2, it is clearly recognizable that a lateral surface part of a hollow cone of roughly equal size, i.e., supports 4, is arranged between each spring element 3 as a support. The circle segment covered in each case by the spring elements 3 and supports 4 may also be of varying size. Thus, it may be advantageous if the circle segment of the supports 4 undercuts the spring elements 3, as a result of which even those strands 11 of the cleaning element 12 that reach between the spring elements 3 and supports 4 when the mop is inserted are squeezed out.

What is claimed is:

1. A wringing device for cleaning elements of wet and moist mops, the wringing device having a liquid-permeable receptacle (1) configured to be affixed to a container and to wring a cleaning element upon exertion of pressure, the receptacle having rigid supports (4) and deformable wall parts (3) configured such that an inside width of the receptacle changing when the cleaning element is pressed in due to an effective compressive force of the pressure, wherein the wall parts at least prior to deformation are in the form of spring elements (3), a portion of the spring elements (3) facing an inside of the receptacle at least prior to deformation having a convex curvature, which can be deformed by the compression force for enlarging the inside width.

2. The device according to claim 1, wherein the curvature of the spring elements (3) can be reduced by compressing the cleaning element, using the compression force.

3. The device according to claim 1, wherein the spring elements (3) in a funnel-shaped receptacle (1) form a tulip-shaped, downward-tapering squeeze basket (5).

4. The device according to claim 3, wherein a funnel is located at an insertion opening of the squeeze basket.

5. The device according to claim 1, wherein the receptacle (1) has a bottom (7) connected to a mounting frame (6) by supports (4), an upper end (8) of each spring element (3) being joined to the mounting frame (6) and a lower end (9) of each spring element being joined to the bottom (7).

6. The device according to claim 5, wherein the bottom (7) has openings (10).

7. The device according to claim 5, wherein holding lugs (2) are formed on the mounting frame (6) and are configured to affix the receptacle (1) to a rim of a mop bucket (11).

8. The device according to claim 5, wherein the spring elements (3) and the supports (4) are arranged radially around the bottom (7) with interspacing, a water passage opening being formed between each spring element and rigid support lateral.

9. The device according to claim 5, wherein the spring elements (3), seen in a direction of their extension, have a different cross-section or a different profile between the mounting frame (6) and the bottom (7).

10. The device according to claim 1, wherein the receptacle (1) is formed as an injection molded part made of a polymer material.

11. A wringing device for cleaning elements of wet and moist mops, the wringing device having a liquid-permeable receptacle (1) configured to be affixed to a container and to wring a cleaning element upon exertion of pressure, the receptacle having deformable wall parts (3) and an inside width of the receptacle changing when the cleaning element is pressed in due to an effective compressive force of the pressure, wherein the wall parts at least prior to deformation are in the form of spring elements (3) with convex curvature, which can be deformed by the compression force for enlarging the inside width, wherein the receptacle (1) has a bottom (7) connected to a mounting frame (6) by supports (4), an upper end (8) of each spring element (3) being joined to the mounting frame (6) and a lower end (9) of each spring element being joined to the bottom (7), and wherein the supports (4) are designed to be rigid and the spring elements (3) are designed to be flexible.

12. The device according to claim 11, wherein the curvature of the spring elements (3) can be reduced by compressing the cleaning element, using the compression force.

13. The device according to claim 11, wherein the spring elements (3) in a funnel-shaped receptacle (1) form a tulip-shaped, downward-tapering squeeze basket (5).

14. The device according to claim 13, wherein a funnel is located at an insertion opening of the squeeze basket (5).

15. The device according to claim 11, wherein the bottom (7) has openings (10).

16. The device according to claim 11, wherein holding lugs (2) are formed on the mounting frame (G) and are configured to affix the receptacle (1) to a rim of a mop bucket (11).

17. The device according to claim 11, wherein the spring elements (3) and the supports (4) are arranged radially around the bottom (7) with interspacing, a water passage opening being formed between each spring element and rigid support.

18. The device according to claim 11, wherein the spring elements (3), seen in a direction of their extension, have a different cross-section or a different profile between the mounting frame (6) and the bottom (7).

19. An apparatus for wet and moist mopping comprising a scrub mop with a mop head having liquid-absorbing strands, a mop bucket to accommodate cleaning liquid, a funnel-shaped receptacle that can be affixed to the mop bucket for squeezing out the liquid absorbed by the strands of the scrub mop, wherein the receptacle (1) has rigid supports (4) and spring elements (3) which form a tulip-shaped downwards tapering squeeze basket (5) in which the mop head can be inserted from above and the liquid can be wrung out of the strands by compression, said spring elements (3) configured such that said compression enlarging an inside width of the receptacle, a portion of the spring elements facing an inside of the receptacle having a convex curvature.

20. The device according to claim 19, wherein the curvature of the spring elements (3) can be reduced by compressing the cleaning element, using the compression force.

21. The device according to claim 19, wherein the receptacle (1) has a bottom (7) connected to a mounting frame (6) by the supports (4), an upper end (8) of each spring element (3) being joined to the mounting frame (6) and a lower end (9) of each spring element being joined to the bottom (7).

22. The device according to claim 21, wherein the bottom (7) has openings (10).

23. The device according to claim 11, wherein the spring elements (3) and the supports (4) are arranged radially around the bottom (7) with interspacing, a water passage opening being formed between each spring element and rigid support.

24. The device according to claim 21, wherein the spring elements (3), seen in a direction of their extension, have a different cross-section or a different profile between the mounting frame (6) and the bottom (7).

25. The device according to claim 12, wherein holding lugs (2) are formed on a mounting frame (6) and are configured to affix the receptacle (1) to a rim of a mop bucket (11).

26. The device according to claim 19, wherein a funnel is located at an insertion opening of the squeeze basket (5).

* * * * *

UNITED STATES PATENT AND TRADEMARK OFFICE

CERTIFICATE OF CORRECTION

PATENT NO. : 6,823,557 B2
DATED : November 30, 2004
INVENTOR(S) : Dingert

It is certified that error appears in the above-identified patent and that said Letters Patent is hereby corrected as shown below:

Column 4,
Line 27, delete “lateral surface parts”; and

Column 5,
Line 60, change “rigid support lateral” to -- rigid support. --; and

Column 6,
Line 30, change “mounting frame (G)” to -- mounting frame (6) --.

Signed and Sealed this

Twentieth Day of September, 2005

JON W. DUDAS
*Director of the United States Patent and Trademark Office*